US008469106B2

(12) United States Patent
Caminari et al.

(10) Patent No.: US 8,469,106 B2
(45) Date of Patent: Jun. 25, 2013

(54) DOWNHOLE DISPLACEMENT BASED ACTUATOR

(75) Inventors: Richard Caminari, Rosharon, TX (US); Arin Basmajian, Houston, TX (US); Brad Swenson, Houston, TX (US); Steven L. Anyan, Missouri City, TX (US); Grigory Arauz, Missouri City, TX (US); Mark Penner, Willis, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 278 days.

(21) Appl. No.: 12/843,325

(22) Filed: Jul. 26, 2010

(65) Prior Publication Data

US 2012/0018169 A1 Jan. 26, 2012

(51) Int. Cl.
*E21B 34/14* (2006.01)

(52) U.S. Cl.
USPC ..... 166/373; 166/321; 166/334.1; 166/123; 166/181; 166/72

(58) Field of Classification Search
USPC ..... 166/321, 332.4, 123, 181, 373, 72
See application file for complete search history.

(56) References Cited

U.S. PATENT DOCUMENTS

| | | | | |
|---|---|---|---|---|
| 4,907,655 | A | 3/1990 | Hromas | |
| 5,678,635 | A * | 10/1997 | Dunlap et al. | 166/387 |
| 6,945,331 | B2 | 9/2005 | Patel | |
| 7,243,728 | B2 * | 7/2007 | Stoesz et al. | 166/318 |
| 7,322,408 | B2 * | 1/2008 | Howlett | 166/194 |
| 7,337,850 | B2 | 3/2008 | Contant | |
| 2003/0159829 | A1 | 8/2003 | Fripp | |
| 2004/0020657 | A1 * | 2/2004 | Patel | 166/373 |
| 2004/0144546 | A1 | 7/2004 | Read | |
| 2005/0056430 | A1 * | 3/2005 | Dennistoun et al. | 166/321 |
| 2007/0193733 | A1 | 8/2007 | Basmajian et al. | |
| 2007/0284118 | A1 | 12/2007 | Benton | |
| 2010/0126715 | A1 | 5/2010 | Dithmar et al. | |

OTHER PUBLICATIONS

International Search Report and Written Opinion of PCT Application No. PCT/US2011/044034 dated Feb. 23, 2012.

* cited by examiner

*Primary Examiner* — Giovanna Wright

(57) ABSTRACT

A technique facilitates actuating a variety of components in a downhole environment. The technique utilizes displacement based activation of an atmospheric actuation chamber. Activation of the atmospheric actuation chamber may be initiated via a variety of mechanisms, including manipulation of a restraining device, translation of a seal, and/or destruction of a seal. The atmospheric actuation chamber is coupled in cooperation with the corresponding downhole component to enable selective activation of the downhole component.

9 Claims, 3 Drawing Sheets

DOWNHOLE DISPLACEMENT BASED ACTUATOR

BACKGROUND

In a variety of downhole applications, actuators are used to actuate downhole components, e.g. valves, between operational positions. In purely mechanical applications, however, controlled activation of downhole components typically is a non-trivial problem. Pressure based solutions are not predictable because activation may occur at a variety of positions within a depth range. Similarly, force based solutions, e.g. collets, also are unpredictable because the material properties and dimensions of the collet or similar mechanism vary, thus creating a range of forces which may activate the downhole component. Accordingly, many existing downhole actuation systems lack predictability with respect to controlling activation of downhole components.

SUMMARY

In general, the present invention comprises a technique for activating a variety of components in a downhole environment. The technique utilizes displacement based activation of an atmospheric actuation chamber. Activation of the atmospheric actuation chamber may be initiated via a variety of mechanisms, such as manipulation of a restraining device, translation of a seal, and/or destruction of a seal. The atmospheric actuation chamber is coupled in cooperation with the corresponding downhole component to enable selective activation of the downhole component.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique for activating a device in a wellbore environment. The technique provides a displacement based solution which enables activation of a downhole component only when a particular action occurs. The particular action may be triggered by a significantly smaller force relative to force based solutions while substantially increasing reliability with respect to activation of the downhole component. The increased reliability is particularly helpful in operating a variety of downhole components, such as isolation valves, in which it is important to ensure profile engagement before applying large forces. The present technique enables activation of such devices with reduced risk of inadvertent, e.g. premature, activation.

In one embodiment, an actuation system provides displacement based activation of an atmospheric actuation chamber. The displacement based activation is achieved through the controlled manipulation of a variety of mechanisms. For example, the displacement based activation may be caused via the release of a restraining device, via translation of a seal, and/or via intentional destruction of a seal. In some applications, displacement interactions may be employed to break a seal and open communication with the hydrostatic pressure present at a downhole location. In other applications, manipulation of the mechanism to initiate activation may comprise releasing a collet or breaking a frangible member, e.g. breaking a shear pin restrained in an atmospheric piston. In still other applications, manipulation of the mechanism to initiate activation may comprise moving a mandrel to shift a sliding sleeve or other member to open communication with the external hydrostatic pressure.

The displacement based activation also may be initiated via service tool activation. For example, a service tool having a shifting member may be passed through an interior of an actuation assembly to release hydrostatic pressure into an atmospheric chamber. For example, the shifting member may be used to engage a sliding sleeve (possibly with a collet profile) positioned in a flow-through diameter. In this embodiment, the sliding sleeve is moved by the shifting member to expose an atmospheric chamber to hydrostatic. In other embodiments, the atmospheric chamber may be exposed to the surrounding hydrostatic pressure by moving the actuation assembly through an engagement profile in a surrounding tubular structure, e.g. surrounding liner.

Figure 1:
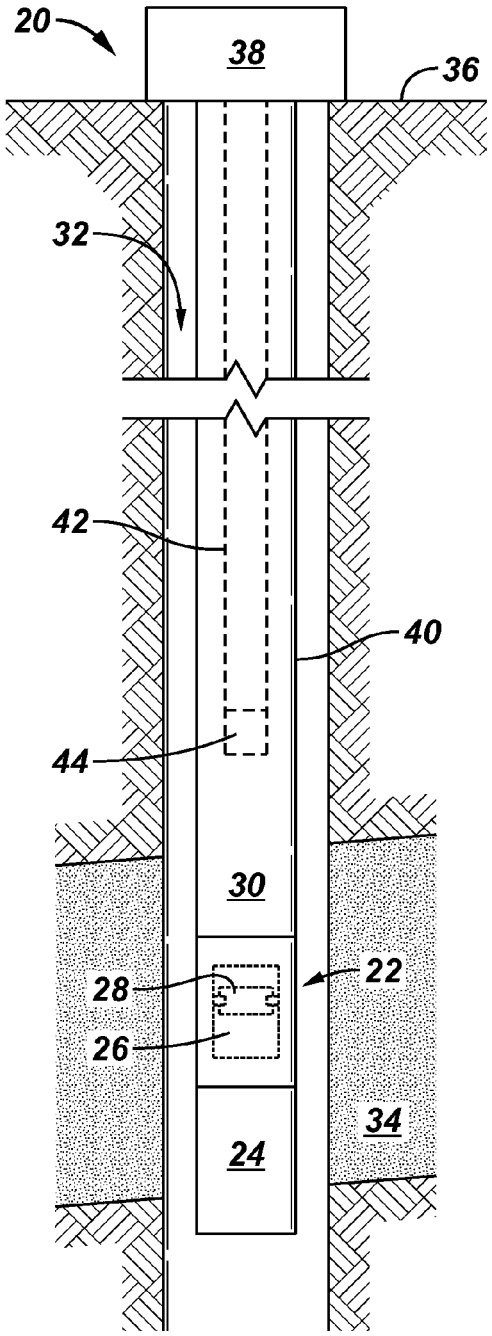
FIG. 1 is a schematic view of a well system having an actuator with an atmospheric actuation chamber, according to an embodiment of the present invention.

Referring generally to FIG. 1, one example of a generic well system 20 is illustrated as employing an actuation assembly 22 used to activate a downhole component 24, such as a flow isolation valve, packer, or other well tool. In this embodiment, the actuation assembly 22 comprises at least one atmospheric chamber 26 which slidably receives an actuating piston 28. The actuation assembly 22 and downhole component 24 may be constructed as part of a larger string of downhole equipment 30. For example, the actuation assembly 22 and downhole component 24 may be part of an overall completion 30 or other downhole equipment that is deployed downhole in a wellbore 32.

Generally, the wellbore 32 is drilled down into or through a formation 34 that may contain desirable fluids, such as hydrocarbon based fluids. The wellbore 32 extends down from a surface location 36 beneath surface equipment 38, such as a wellhead selected for the given application. A conveyance 40, e.g. coiled tubing, production tubing, cable, or other suitable conveyance, may be used to deploy completion 30 downhole into wellbore 32.

In the embodiment illustrated in FIG. 1, a displacement based activation of the atmospheric actuation chamber 26 is selectively controlled. In this particular example, initiation of the activation of atmospheric chamber 26 may be caused by delivering a tool string 42 down the wellbore 32 and through actuation assembly 22. By way of example, the tool string 42 comprises an actuating member 44 sized to pass into an interior of the actuation assembly 22 in a manner which activates atmospheric chamber 26.

Figure 2:
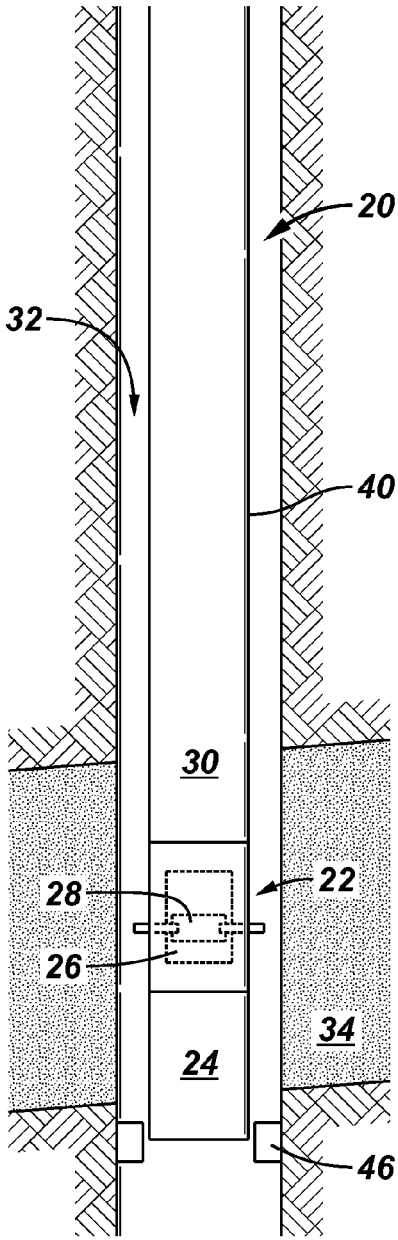
FIG. 2 is a schematic view of another example of the well system having an actuator with an atmospheric actuation chamber, according to an alternate embodiment of the present invention.

In an alternate embodiment illustrated in FIG. 2, well system 20 again utilizes a controlled, displacement based activation of the atmospheric actuation chamber 26. In this alternate example, initiation of the activation of atmospheric chamber 26 may be caused by moving downhole equipment 30 and its actuation assembly 22 through an external profile 46 or other type of mechanical device. The external profile/mechanical device 46 interacts with actuation assembly 22 in a manner designed to activate atmospheric chamber 26.

Figure 3:
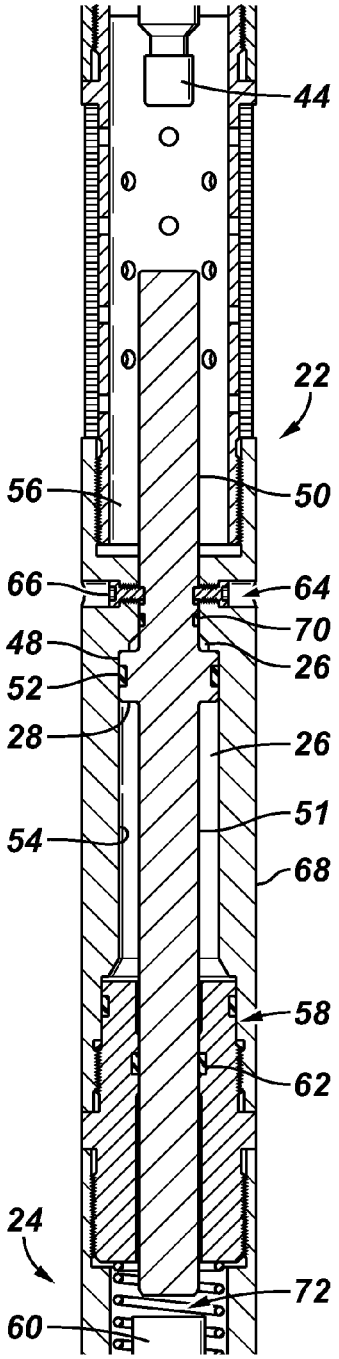
FIG. 3 is a cross-sectional view of an actuation assembly comprising an atmospheric actuation chamber, according to an embodiment of the present invention.
Figure 4:
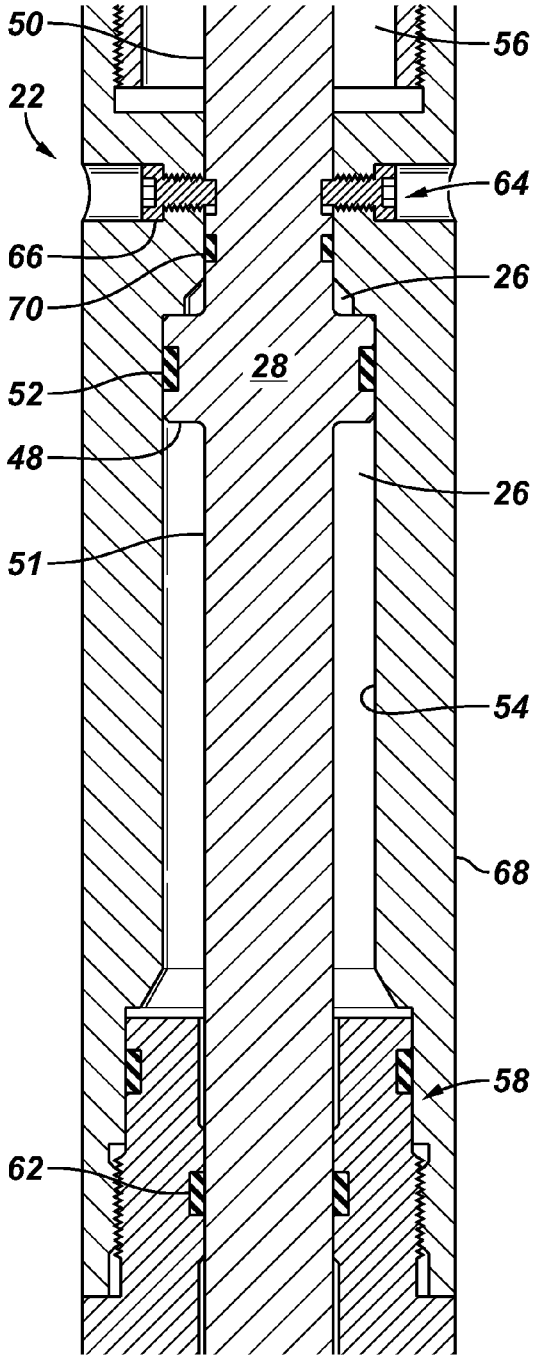
FIG. 4 is an enlarged view of a portion of the actuation assembly illustrated in FIG. 3, according to an embodiment of the present invention.

Referring generally to FIGS. 3 and 4, one embodiment of actuation assembly 22 is illustrated. In this embodiment, actuation assembly 22 comprises actuating piston 28 disposed in atmospheric chamber 26 for slidable movement along the atmospheric chamber. By way of example, piston 28 may comprise a radially expanded region 48 from which axial extensions 50, 51 extend in opposite axial directions through the actuation assembly 22. The radially expanded region 48 comprises one or more seals 52, e.g. O-ring seals, positioned to seal against a surrounding chamber wall 54 which defines atmospheric chamber 26.

The axial extension 50 extends into a communication chamber 56 which provides hydrostatic communication with the surrounding tubing. In other words, the interior of communication chamber 56 is exposed to the hydrostatic pressure existing at the downhole wellbore location to which actuation assembly 22 is deployed. The opposed axial extension 51 extends through actuation assembly 22 in an opposite direction and through a seal structure 58 for potential engagement with an actuating portion 60 of the downhole component 24. In this particular example, seal structure 58 serves to connect actuation assembly 22 with downhole component 24 and provides one or more seals 62 which seal against axial extension 51.

Initially, piston 28 is held within atmospheric chamber 26 at a preliminary position with, for example, a mechanical device 64. Mechanical device 64 may comprise a frangible member 66, such as one or more shear pins extending between the axial extension 50 and a housing 68 containing atmospheric chamber 26, as best illustrated in FIG. 4. The frangible member 66 may be selectively broken by engaging actuating member 44 with axial extension 50. In an alternate embodiment, such as the embodiment illustrated in FIG. 2, the frangible member 66 may be designed to break upon engagement with external profile 46. In other embodiments, mechanical device 64 comprises a flexible release mechanism, such as a collet or spring member.

Referring again to FIG. 4, this embodiment of actuation assembly 22 also comprises an activation seal 70 which protects atmospheric chamber 26 from external hydrostatic pressure entering through communication chamber 56 while piston 28 is in the preliminary position illustrated in FIGS. 3 and 4. As a result, the atmospheric chamber 26 is activated by jarring onto frangible member 66 via mechanically contacting axial extension 50 with, for example, actuating member 44. The contact is sufficient to break frangible member 66 which allows the actuating piston 28 to shift and close a gap 72 between axial extension 51 and the actuating portion 60 of downhole tool/component 24.

During this initial shifting of actuating piston 28, the activation seal 70 is sufficiently shifted to unseat from the surrounding wall of housing 68 and to permit communication of hydrostatic pressure from communication chamber 56 to atmospheric chamber 26 on a first side of piston 28. In an alternate approach, seal 70 may be intentionally damaged/destroyed (e.g. cut or torn during translation) to break the seal and thus permit communication of the hydrostatic pressure. Prior to disengagement of activation seal 70 from the surrounding wall of housing 68 (or prior to destruction of the seal 70), piston 28 is exposed to balanced pressure on both axial sides of radially expanded region 48. However, once seal 70 loses its integrity the hydrostatic tubing pressure from communication chamber 56 creates a pressure differential across atmospheric seal 52. This pressure differential establishes a net force acting on piston 28 and causes piston 28 to move along atmospheric chamber 26 in a direction toward actuating portion 60. In this example, the net force is sufficient to move actuating portion 60 and to actuate downhole component 24.

In another embodiment, the actuation assembly 22 is designed with a multi-stage atmospheric chamber 26. The multi-stage atmospheric chamber 26 is useful in reducing the failure rate of a variety of downhole components 24, such as formation isolation valves. In such downhole components 24, debris is sometimes caught between parts undergoing relative movement, or moving parts may become cocked against one another. In these types of situations, one approach for retaining operability of the downhole component 24 is to pull back against the primary direction of motion and then to reapply force in the primary direction. This double action or reverse movement may allow the parts to become uncocked or to release debris stuck between the moving parts.

In one embodiment, the multi-stage atmospheric chamber 26 may be employed in an actuation assembly 22 for use with downhole component 24 in the form of a formation isolation valve. The multi-stage atmospheric chamber design allows a dual shifting motion which can shift open a stuck, or partially open, formation isolation valve 24. If, for example, a wiper ring or other component of the formation isolation valve becomes unseated and caught between a valve ball and a seal retainer, the dual action of the multi-stage atmospheric chamber design allows initial turning of the ball in a reverse direction followed by a reattempt to actuate the ball. Often, this dual direction actuation succeeds when simple brute force would fail. Similarly, if a piece of debris becomes lodged between the ball and an upper cage of the formation isolation valve, reversing the turning direction of the ball and then reattempting to actuate the ball may again facilitate proper functioning of the valve.

Figure 5:
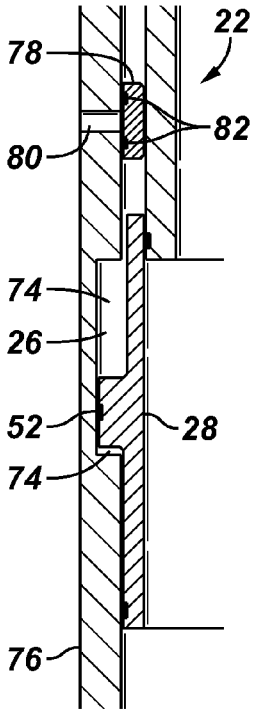
FIG. 5 is a view of one system for initiating a desired actuation of the actuation assembly, according to an embodiment of the present invention.
Figure 6:
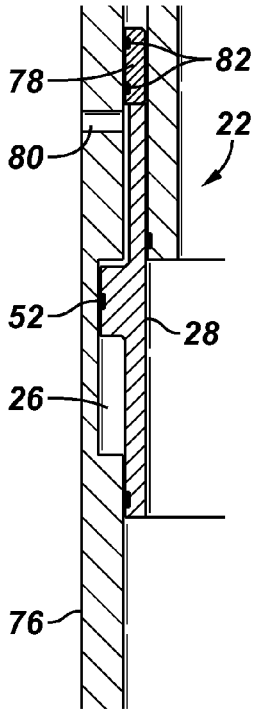
FIG. 6 is a view similar to that of FIG. 5 with the actuation assembly in a different operational position, according to an embodiment of the present invention.
Figure 7:
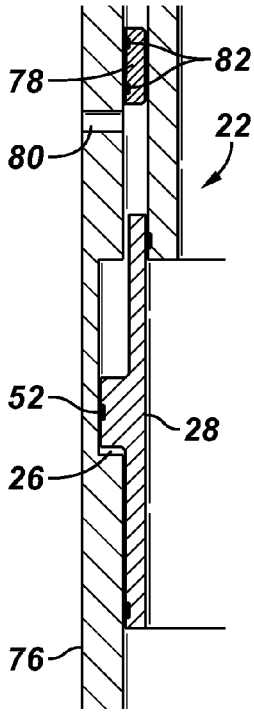
FIG. 7 is a view similar to that of FIG. 5 with the actuation assembly in a different operational position, according to an embodiment of the present invention.

Referring generally to FIGS. 5-7, a portion of one embodiment of the actuation assembly 22 is illustrated as designed with atmospheric chamber 26 in the form of a multi-stage atmospheric chamber. In this embodiment, actuating piston 28 is again slidably positioned within atmospheric chamber 26. However, the actuating piston 28 and atmospheric chamber 26 are constructed to create two chambers 74 having different cross-sectional areas during an initial state, as illustrated in FIG. 5. As the actuating piston 28 reacts to a pressure differential between hydrostatic pressure within a tubing 76 of the downhole equipment 30 and an opposed atmospheric chamber 74 (the upper chamber 74 as illustrated in FIG. 5), the actuating piston 28 begins to move. The piston 28 continues its movement until it encounters a hydrostatic pressure blocking member 78, as illustrated in FIG. 6.

The member 78 is initially positioned over a hydrostatic pressure port 80 extending through tubing 76. By way of example, blocking member 78 may comprise a sliding sleeve having seals 82 which protect the upper chamber 74 from hydrostatic pressure while member 78 is positioned over port 80. The hydrostatic pressure within tubing 76, however, causes the actuating piston 28 to move blocking member 78 and to break its sealing of port 80, as illustrated in FIG. 7. Once port 80 is opened, the illustrated upper chamber 74 is flooded with fluid and exposed to hydrostatic pressure. Because of the different cross-sectional areas exposed to the hydrostatic pressure, a pressure differential is created across piston seal 52, and the actuating piston 28 is forced downwardly, as illustrated in FIG. 7. This multi-stage atmospheric chamber and dual action provides the back-and-forth motion which can be used to free a stuck valve or to perform other desired actuating operations.

It should be noted that the description of upper/lower chamber 74 is merely with reference to the specific figures. The actual orientation of one chamber 74 relative to the other chamber 74 may vary depending on the design of actuation assembly 22 and/or the orientation of wellbore 32, e.g. vertical or deviated. Additionally, the blocking member 78 may be created according to a variety of designs. For example, blocking member 78 may comprise one or more shear plugs instead of the illustrated sliding sleeve.

Figure 8:
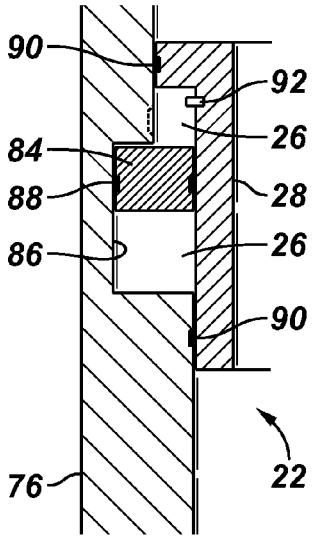
FIG. 8 is a view of an alternate system for initiating a desired actuation of the actuation assembly, according to an embodiment of the present invention.
Figure 9:
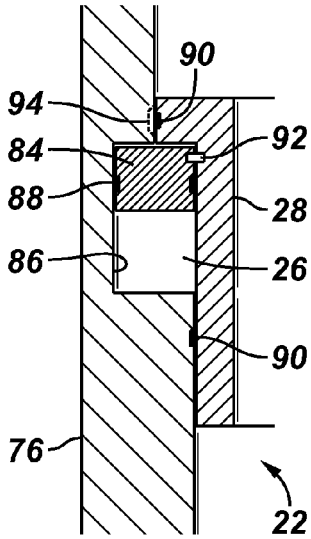
FIG. 9 is a view similar to that of FIG. 8 with the actuation assembly in a different operational position, according to an embodiment of the present invention.
Figure 10:
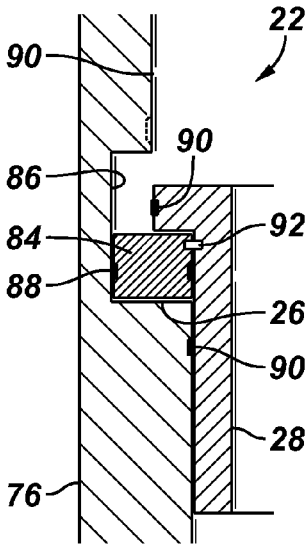
FIG. 10 is a view similar to that of FIG. 8 with the actuation assembly in a different operational position, according to an embodiment of the present invention.

Referring generally to FIGS. 8-10, another embodiment of actuation assembly 22 is illustrated. In this embodiment, the actuation assembly 22 is designed to utilize a shouldering stage. In other words, the actuating piston 28 moves to a shoulder or shoulder trigger 84 which allows hydrostatic pressure at the downhole location to translate actuating piston 28 and to thus activate downhole component 24. As explained in greater detail below, latching the actuating piston 28 with the shoulder trigger 84 changes the surface area to create a pressure differential and this results in a change of magnitude in the output force.

Shoulder trigger 84 is positioned within atmospheric chamber 26 between actuating piston 28 and tubing 76. For example, shoulder trigger 84 may be slidably mounted within a recess 86 formed in an interior sidewall of tubular 76 and sealed against the tubular 76 via a seal 88. Additionally, actuating piston 28 relies on a pair of seals 90 which define atmospheric chamber 26 when actuating piston 28 is at a preliminary operational position, as illustrated in FIG. 8.

When actuation assembly 22 is to activate downhole component 24, piston 28 is moved into engagement with shoulder trigger 84 and locked thereto via a locking mechanism 92, as illustrated in FIG. 9. The actuating piston 28 may be moved into engagement with shoulder trigger 84 via an appropriate tool, such as actuating member 44, external profile 46, a mandrel, or another suitable tool. Once locked together, an alternate flow path 94 allows fluid to flood into one side of atmospheric chamber 26. The increased surface area of the combined piston 28 and shoulder 84 enables the hydrostatic pressure to drive the actuating piston to a subsequent position, as illustrated in FIG. 10. Movement of actuating piston 28 to the subsequent position actuates downhole component 24.

The alternate flow path 94 may be formed via a variety of mechanisms and techniques. For example, the alternate flow path may be created with an undercut channel where one side passes beyond the seal at a known displacement, thus allowing communication of hydrostatic pressure into the atmospheric chamber. In another example, the alternate flow path 94 may be created with a hole placed such that a seal passes underneath or over the hole in a manner that enables communication of fluid and hydrostatic pressure. This type of actuation assembly 22 can be used in a variety of applications, including as a soft stop on a mandrel, as a stroke limitation technique, as a method of changing the magnitude of applied force, and/or as a mechanism for changing the direction of motion.

Well system 20 and actuation assembly 22 may be designed to incorporate a variety of atmospheric chambers 26. In some applications, atmospheric chambers may be combined or chained together to produce a more complicated movement or force pattern. For example, by combining a sliding sleeve direction change (see FIGS. 5-7) with a shouldering activation (see FIGS. 8-10), a more complicated movement can be created in the form of an uphole pull with significant force, a small downward force, and then a larger downward force. Many other movement and force patterns can be developed through various combinations of atmospheric chambers, actuating pistons, and cooperating components.

Additionally, the actuation assembly, downhole component, and overall well system 20 may be designed in a variety of configurations to accommodate specific actuation needs of a desired downhole application. The various components employed in the well system may be formed from a variety of materials and constructed in several sizes and configurations. The well system may use an individual actuation assembly or a plurality of actuation assemblies designed to actuate one or more types of downhole components. Furthermore, the actuation assemblies may be employed in production applications, injection applications, and a variety of other well related applications.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of activating a device in a wellbore, comprising:

mounting an actuating piston in an atmospheric chamber of an actuation assembly;

holding the actuating piston at a preliminary position with a mechanical device;

moving the actuation assembly downhole into a wellbore until the actuating piston is exposed to an actuating pressure;

mechanically altering the mechanical device to release the actuating piston for movement along the atmospheric chamber;

upon mechanically altering the mechanical device, breaking the integrity of a seal to enable communication of hydrostatic pressure from a communication chamber to the atmospheric chamber to create a pressure differential across a piston seal of the actuating piston; and using movement of the actuating piston to actuate a device downhole.

2. The method as recited in claim 1, further comprising providing an open gap between the actuating piston and an actuating portion of the device when the actuating piston is at the preliminary position.

3. The method as recited in claim 1, wherein holding comprises holding the actuating piston with a frangible member.

4. The method as recited in claim 3, wherein mechanically altering comprises breaking a shear pin forming the frangible member.

5. The method as recited in claim 1, wherein holding comprises holding the actuating piston with a flexible release member.

6. The method as recited in claim 1, wherein mechanically altering comprises releasing the mechanical device by passing an actuating member through an interior of the actuation assembly to activate the atmospheric chamber.

7. The method as recited in claim 1, wherein mechanically altering comprises releasing the mechanical device by passing an actuating member along an exterior of the actuation assembly to activate the atmospheric chamber.

8. The method as recited in claim 1, further comprising positioning the piston within atmospheric chambers of differing cross-sectional areas on opposite sides of the piston.

9. The method as recited in claim 1, further comprising joining the actuating piston with another component to change a surface area acted on by a pressure differential, thus facilitating movement of the actuating piston along the atmospheric chamber.

* * * * *